US006599105B1

(12) United States Patent
Cahill

(10) Patent No.: US 6,599,105 B1
(45) Date of Patent: Jul. 29, 2003

(54) FAN MOTOR PRESSURE HOUSING, COMPRISING A MOTOR HOUSING AND A MOTOR SHROUD WITH AN AIR COOLING PASSAGE THERE BETWEEN

(75) Inventor: Frank E. Cahill, Lenexa, KS (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 10/063,122

(22) Filed: Mar. 22, 2002

(51) Int. Cl.[7] ..... F04B 39/06

(52) U.S. Cl. ..... 417/368; 417/423.1; 417/423.14; 417/423.8; 417/366; 415/175; 415/176

(58) Field of Search ..... 417/423.1, 423.8, 417/423.14, 423.9, 366, 353, 354, 368; 60/262; 416/94, 245 R; 415/175, 176, 221

(56) References Cited

U.S. PATENT DOCUMENTS 2,776,089 A * 1/1957 Burrowes et al. ..... 417/338
3,957,230 A * 5/1976 Boucher et al. ..... 244/53 R
4,832,576 A * 5/1989 Deguchi et al. ..... 417/45
5,163,814 A * 11/1992 Hutter et al. ..... 416/100
5,252,875 A * 10/1993 Veronesi et al. ..... 310/114
5,678,306 A * 10/1997 Bozeman et al. ..... 29/888.025
5,795,133 A 8/1998 Hill et al. ..... 416/247
6,015,262 A * 1/2000 Huang ..... 416/100
6,074,182 A * 6/2000 Matson ..... 417/423.15
6,139,275 A * 10/2000 Noda et al. ..... 416/203
6,196,803 B1 3/2001 Hill et al. ..... 416/244 R
6,419,460 B1 * 7/2002 Dantlgraber ..... 417/366
6,439,862 B2 8/2002 Chen
6,532,731 B2 * 3/2003 Springer ..... 60/226.1

OTHER PUBLICATIONS

Fred E. Weick; "Drag and Cooling with Various Forms of Cooling for a 'Whirlwind' Radial Air–Cooled Engine–I," NACA Technical Report No. 313 (Oct. 13, 1928).
Anthony C Occhipinti, "More Speed with Less $$," Sport Aviation pp. 77–79 (Jan. 1998).

* cited by examiner

*Primary Examiner*—Charles G. Freay
*Assistant Examiner*—Emmanuel Sayoc
(74) *Attorney, Agent, or Firm*—Hovey Williams LLP

(57) ABSTRACT

A propeller-type fan including a pressure housing for improving air flow past a motor which powers the fan.

51 Claims, 3 Drawing Sheets

FAN MOTOR PRESSURE HOUSING, COMPRISING A MOTOR HOUSING AND A MOTOR SHROUD WITH AN AIR COOLING PASSAGE THERE BETWEEN

BACKGROUND OF THE INVENTION

1. Field of the Invention

The present invention relates generally to propeller-type fans for displacing fluids. In another aspect, the invention concerns an energy efficient, quiet, and aesthetically pleasing fan having a propeller directly coupled to a drive shaft of the fan motor.

2. Description of the Prior Art

Most conventional propeller-type fans, especially air circulators, are produced without regard for controlling the air flow past the fan motor. Usually the motor is left exposed in the air stream where it contributes significantly to the aerodynamic drag of the fan system and adversely affects air flow. The adverse air flow is characterized as turbulent air flow that contributes to reduced operating efficiency, poor motor cooling, and increased operating noise. The exposed motor offers poor aesthetic appeal in applications where styling is of economical importance. Further, if the exposed motor becomes hot during operation, its outer surface could cause discomfort or even burns if touched by a human.

SUMMARY OF THE INVENTION

It is, therefore, an object of the present invention to provide a propeller-type fan having an enhanced aerodynamic configuration that minimizes turbulence of the air flowing past the fan motor.

A further object of the invention is to provide a propeller-type fan having enhanced energy efficiency.

A still further object of the present invention is to provide a propeller-type fan having reduced noise output.

A yet further object of the invention is to provide a more streamlined and aesthetically pleasing propeller-type fan.

Another object of the invention is to provide a propeller-type fan which provides for enhanced cooling of the fan motor.

Still another object of the invention is to provide a propeller-type fan having a cover over the fan motor to reduce the risk of human injury due to physical contact with a hot outer surface of the motor.

Yet another object of the invention is to provide a system for enhancing the efficiency of a propeller-type fan by separating the air flowing past the fan motor into a cooling air stream which passes over the motor and a general air stream which is separated from the motor.

It should be understood that the above-listed objects are only exemplary, and not all the objects listed above need be accomplished by the invention described and claimed herein.

Accordingly, in one embodiment of the present invention, there is provided a fan comprising a motor housing and a motor shroud. The motor housing presents an axially extending outer sidewall surface. The motor shroud is radially spaced from the outer sidewall surface and surrounds at least a portion of the outer sidewall surface. The motor shroud presents inner and outer shroud surfaces. The inner shroud surface and outer sidewall surface define an axially extending cooling air passageway therebetween.

In another embodiment of the present invention, there is provided a fan comprising a motor, a drive shaft, a fan blade assembly, a spinner, a distributor core, and a motor shroud. The motor includes a housing having first and second axially spaced end walls and a sidewall extending between the end walls. The drive shaft is rotatable on a motor axis and is powered by the motor. The drive shaft extends out of the motor through the first end wall. The fan blade assembly includes a hub which is rigidly coupled to the drive shaft. The spinner is rigidly coupled to the drive shaft and at least partly covers the hub. The spinner presents a substantially smooth outer spinner surface having a rounded spinner end portion. The distributor core is rigidly coupled to the motor proximate the second end wall. The distributor core presents a substantially smooth outer core surface having a rounded core end portion. The motor shroud is radially spaced from and surrounds at least a portion of the sidewall.

In a further embodiment of the present invention, there is provided a method for circulating air. The method comprises the steps of: (a) rotating a fan blade assembly to thereby force air to flow past a motor which provides power for rotating the fan blade assembly; and (b) separating the air flowing past the motor into a cooling air flow and a general air flow, said cooling air flow flowing between an outer sidewall surface of the motor and an inner shroud surface of a motor shroud surrounding the motor, said general air flow flowing outside an outer shroud surface of the motor shroud.

BRIEF DESCRIPTION OF DRAWINGS

A preferred embodiment of the present invention is described in detail below with reference to the attached drawing figures, wherein.

DETAILED DESCRIPTION

Figure 2:
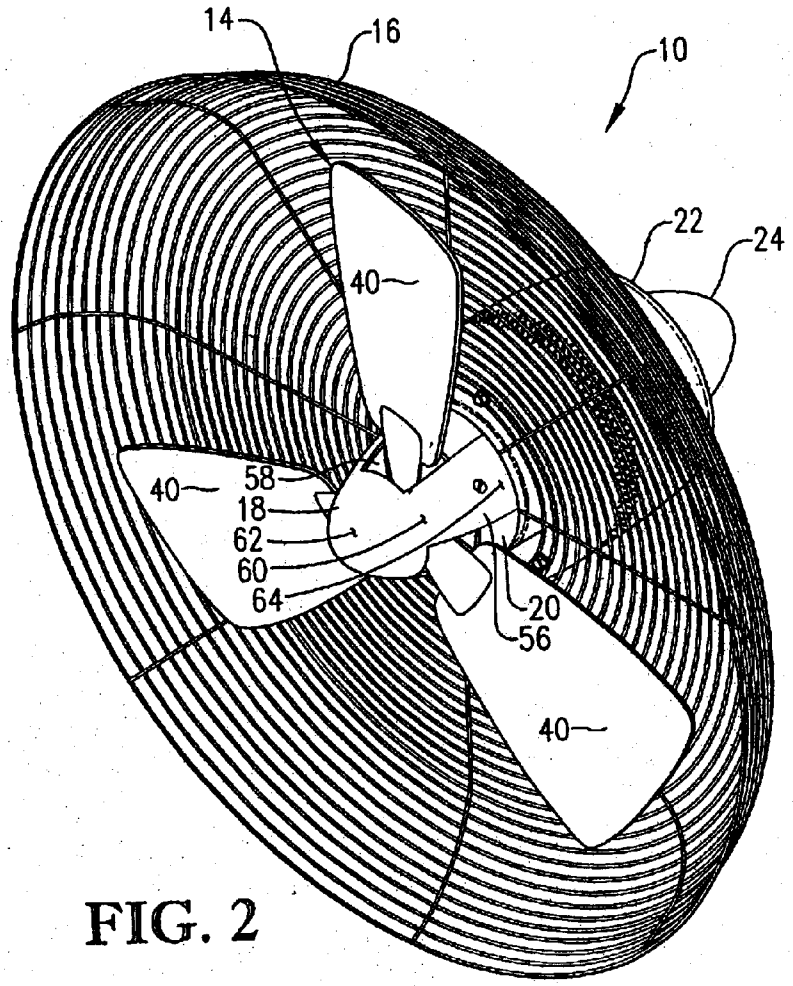
FIG. 2 is a front isometric view of the fan illustrated in FIG. 1, particularly illustrating the spinner of the pressure housing.

Referring initially to FIGS. 1–4, a propeller-type fan 10 is illustrated as generally comprising a fan motor 12 (best shown in FIGS. 3 and 4), a fan blade assembly 14, a buttress guard 16, and a pressure housing. The pressure housing comprises a spinner 18 (best shown in FIGS. 2–4), a backplate 20 (best shown in FIGS. 2–4), a motor shroud 22, and a distributor core 24 (best shown in FIGS. 1 and 4). The pressure housing provides a streamlined shape which reduces drag forces (both induced drag and parasitic drag) and turbulent air flow.

Figure 3:
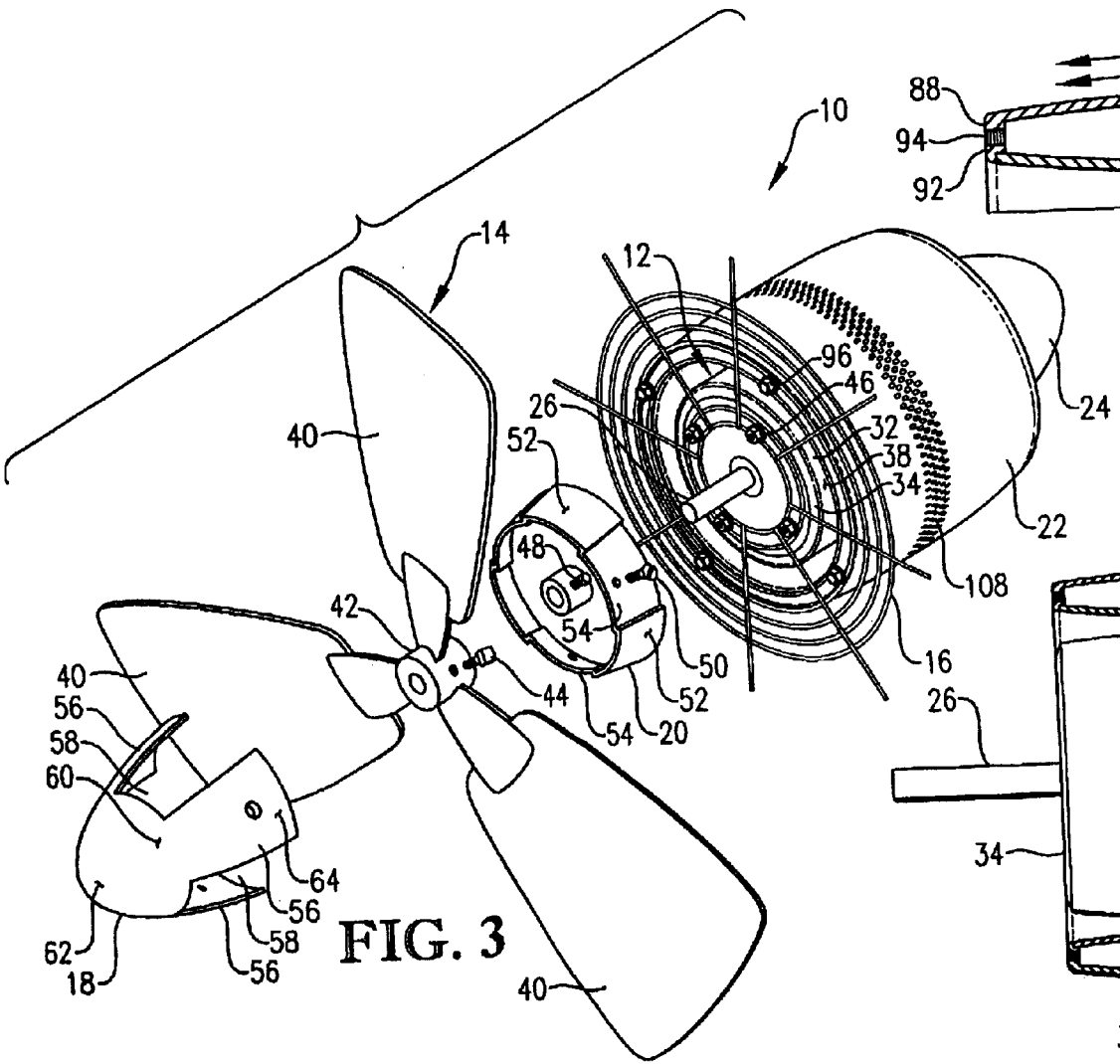
FIG. 3 is a partial front isometric assembly view of a fan having a pressure housing, particularly illustrating the manner in which the baseplate, fan blade assembly, and spinner are coupled to the drive shaft of the motor.
Figure 4:
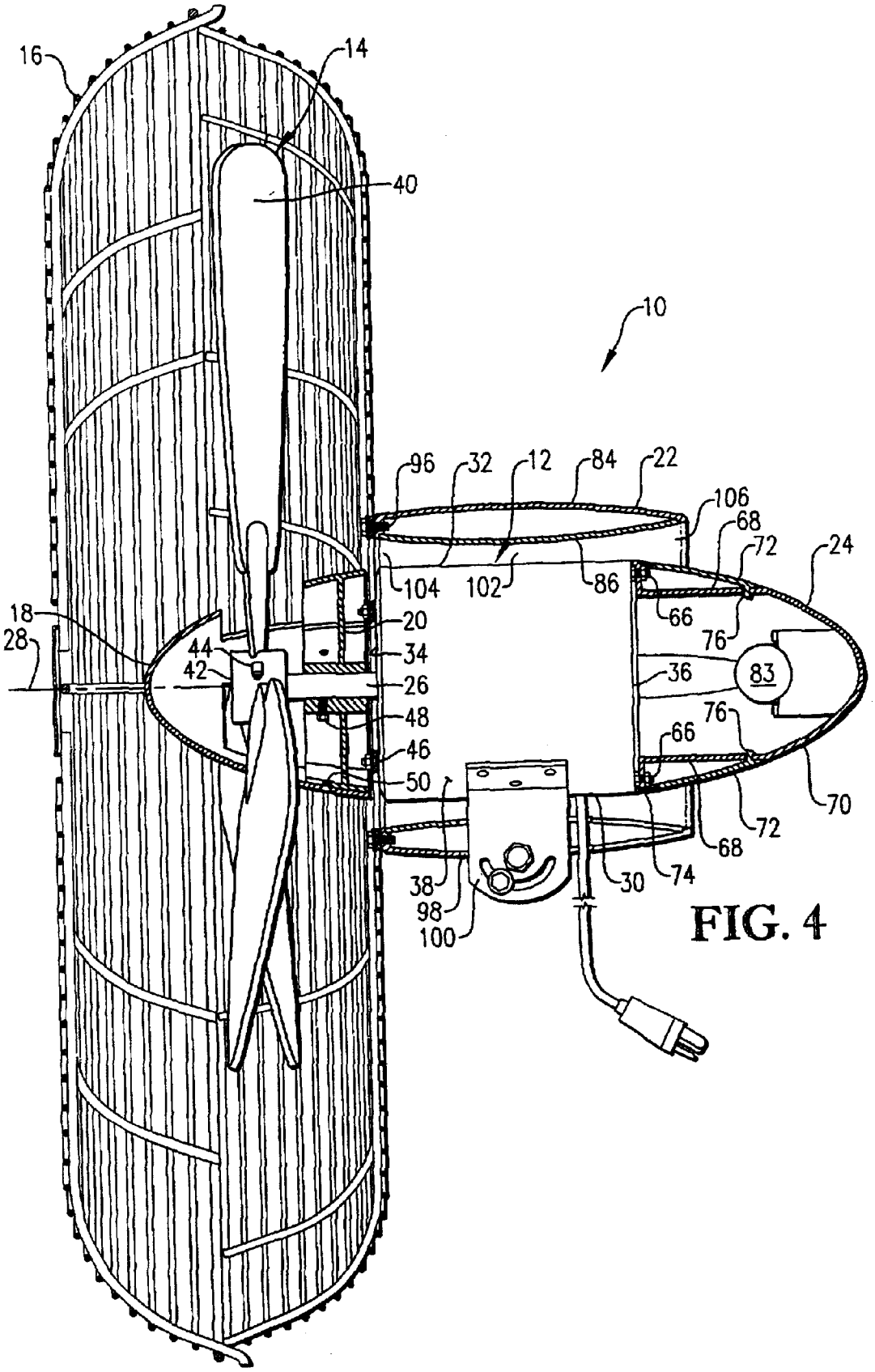
FIG. 4 is a partial sectional side view of a fan having a pressure housing, particularly illustrating the manner in which the components of the pressure housing (i.e., the spinner, the back plate, the motor shroud, and the distributor core) are coupled to the motor.

Referring now to FIGS. 3 and 4, fan motor 12 can be any type of powering device capable of rotating fan blade assembly 14 at a speed suitable for displacing a desired amount of air. Motor 12 is preferably a standard electric motor operable to rotate a drive shaft 26 which protrudes outwardly from motor 12 on a motor axis 28 (shown in FIG. 4). The internal components of motor 12 are enclosed in a motor housing 30 of motor 12. Motor housing 30 includes an axially extending substantially cylindrical sidewall 32 and a pair of substantially flat axially spaced first and second end walls 34, 36 coupled to the ends of sidewall 32. Sidewall 32 presents a substantially cylindrical, substantially smooth outer sidewall surface 38.

Fan blade assembly 14 includes a plurality of fan blades 40 extending radially from a hub 42. Fan blade assembly 14 is rigidly coupled to drive shaft 26 by positioning drive shaft 26 in a central opening in hub 42 and tightening a hub set screw 44 against drive shaft 26. Thus, motor 12 causes fan blade assembly 14 to rotate on motor axis 28, thereby displacing air with fan blades 40. Fan blade assembly 14 is preferably enclosed in buttress guard 16. Buttress guard 16 is a cage-like structure which prevents external objects from contacting fan blades 40 when fan blade assembly 14 is rotated by motor 12. Buttress guard 16 is preferably coupled to fan motor 12 proximate first end wall 34. Preferably, buttress guard 16 is coupled to first end wall 34 by a plurality of threaded guard fasteners 46. Each threaded guard fastener 46 can include a threaded stud, a washer, and a nut. The threaded stud extends through buttress guard 16 and into first end wall 34. The nut can be threadably received on the stud. When the nut is tightened on the stud, the stud, washer, and nut of threaded guard fastener 46 cooperate to rigidly couple buttress guard 16 to first end wall 34 of fan motor 12.

Referring to FIGS. 2–4, spinner 18 is coupled to drive shaft 26 of fan motor 12 via backplate 20. As perhaps best shown in FIG. 3, backplate 20 is coupled to drive shaft 26 prior to coupling fan blade assembly 14 to drive shaft 26. To rigidly couple backplate 20 to drive shaft 26, drive shaft 26 is inserted through a central bore in backplate 20 and a backplate set screw 48 is then tightened against drive shaft 26. After backplate 20 and fan blade assembly 14 are coupled to drive shaft 26, spinner 18 can be placed over hub 42 and coupled to backplate 20 via a plurality of spinner screws 50. Backplate 20 presents a plurality of substantially smooth outer backplate surfaces 52 and a plurality of spinner recesses 54 interposed between outer backplate surfaces 52. Spinner 18 includes a plurality of fingers 56 adapted to be received in spinner recesses 54 of backplate 20. Fingers 56 define a plurality of blade openings 58 therebetween. Blade openings 58 allow fingers 56 to be slid past fan blades 40 and inserted into spinner recesses 54. Spinner 18 presents a substantially smooth outer spinner surface 60 which includes a rounded spinner end portion 62 and a spinner base portion 64. Preferably, outer spinner surface 60 has a generally truncated ellipsoidal shape. The shape and smoothness of outer spinner surface 60 reduces turbulent air flow and drag as air is passed over spinner 18. When spinner fingers 56 are received in spinner recesses 54, outer backplate surfaces 52 and spinner base portion 64 of outer spinner surface 60 are substantially flush with one another, thereby minimizing turbulence and drag. As best shown in FIG. 4, outer backplate surfaces 52, spinner base portion 64, and outer sidewall surface 38 have substantially the same radius of curvature to thereby minimize flow disruption as air flows axially over the adjacent surfaces 38, 52, 64. The gap between backplate 20 and motor 12 is preferably minimal. Most preferably, the gap between backplate 20 and motor 12 is substantially filled by a circular grill wire of buttress guard 16 which has substantially the same radius of curvature as the outer surface of motor sidewall 32.

Figure 1:
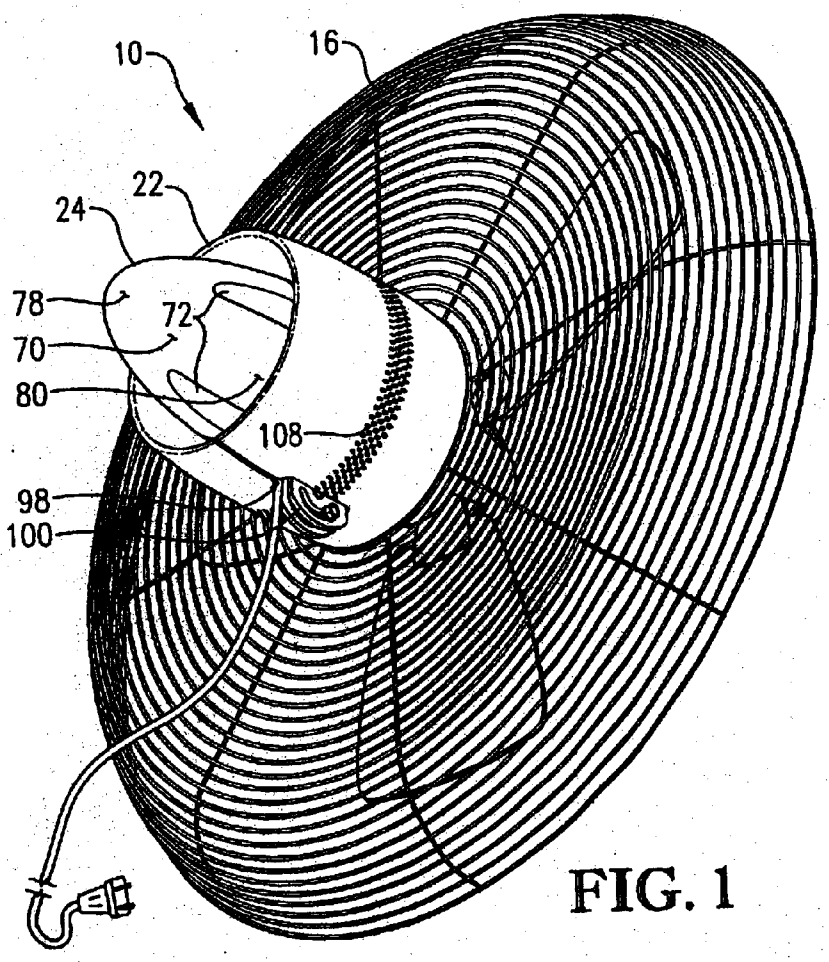
FIG. 1 is a rear isometric view of a fan constructed in accordance with the principles of the present invention, particularly illustrating the motor shroud and distributor core of the pressure housing.

Referring to FIGS. 1 and 4, distributor core 24 is coupled to fan motor 12 proximate second end wall 36. As best shown in FIG. 4, distributor core 24 is preferably coupled to second end wall 36 via a plurality of threaded core fasteners 66. Each threaded core fastener 66 can include a threaded stud, a washer, and a nut. Each threaded stud extends through distributor core 24 and into second end wall 36. The nut can be threadably received on the stud. When the nut is tightened on the stud, the stud, washer, and nut of threaded core fastener 66 cooperate to rigidly couple distributor core 24 to second end wall 36. Each threaded core fastener 66 is at least partially received in an individual screw socket 68 of distributor core 24 which is recessed relative to an outer core surface 70. After distributor core 24 is coupled to fan motor 12 via threaded core fasteners 66, each screw socket 68 can be covered by a fairing 72, thereby giving distributor core 24 a substantially smooth outer core surface 70. Fairings 72 can include a protruding position pin 74 which can be received in an alignment hole in screw socket 68. Fairings 72 can also include a flexible spring clip 76 which can be received in a clip opening in screw socket 68. Thus, fairing 72 can be coupled to distributor core 24 by simply inserting position pin 74 into the alignment holes and then "snapping" spring clip 76 into the attachment holes.

Distributor core 24 presents a substantially smooth outer core surface 70. Outer core surface 70 includes a rounded core end portion 78, a core base portion 80, and a fairing portion 82. Preferably, outer core surface 70 has a generally truncated ellipsoidal shape. The shape and smoothness of outer core surface 70 reduces turbulent air flow and drag as air is passed over distributor core 24. Outer sidewall surface 38 of motor 12 and core base portion 80 of outer core surface 70 preferably have substantially the same radius of curvature so that there is a substantially smooth transition between outer core surface 70 of distributor core 24 and outer sidewall surface 38 of fan motor 12, thereby minimizing turbulent air flow and drag. Distributor core 24 preferably defines an interior space in which motor components, such as, for example, a starting capacitor 83 (shown in FIG. 4) can be housed.

Figure 5:
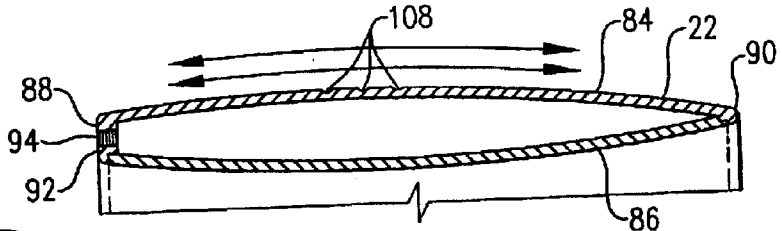
FIG. 5 is a partial sectional side view of the motor shroud, particularly illustrating the shape of the inner and outer shroud surfaces, as well as the attachment wall for coupling the motor shroud to a buttress guard.

Referring now to FIGS. 1, 4, and 5, motor shroud 22 is spaced from and extends radially along outer sidewall surface 38 (shown in FIG. 4) to thereby surround at least a portion of fan motor 12. Referring to FIG. 5, motor shroud 22 generally includes substantially smooth curved outer and inner shroud surfaces 84, 86 extending between a proximal shroud end 88 and a distal shroud end 90. Motor shroud 22 has a thickness which is greater between proximal and distal shroud ends 88, 90 than at proximal and distal shroud ends 88, 90. Thus, outer and inner shroud surfaces 84, 86 converge toward one another as shroud surfaces 84, 86 extend axially toward the proximal and distal shroud ends 88, 90. Outer and inner shroud surfaces 84, 86 converge into abutment with one another at distal shroud end 90. At proximal shroud end 88, a substantially flat attachment wall 92 of motor shroud 22 extends radially between outer and inner shroud surfaces 84, 86. Attachment wall 92 defines a threaded opening 94 for coupling motor shroud 92 to buttress guard 16. Referring to FIGS. 3–5, motor shroud 22 is coupled to buttress guard 16 via a plurality of shroud screws 96 which extend through buttress guard 16 and into threaded openings 94 in attachment wall 92 of motor shroud 22. Preferably, buttress guard 16 is the sole means of supporting motor shroud 22 relative to fan motor 12, thereby minimizing flow disruption in the space defined between inner shroud surface 86 and outer sidewall surface 38. Referring to FIGS. 1 and 4, motor shroud 22 defines a support opening 98 extending through outer and inner shroud surfaces 84, 86. A mounting bracket 100 extends through support opening 98 and is adapted to couple fan motor 12 to an external support member.

Referring now to FIG. 4, a cooling air passageway 102 is at least partly defined by and extends axially between inner shroud surface 86 of motor shroud 22 and outer sidewall surface 38 of motor 12. Cooling air passageway 102 extends between first and second open passageway ends 104, 106. Cooling air passageway 102 can be narrower (i.e., its radial cross-sectional area is less) between first and second passageway ends 104, 106 than at first and second passageway ends 104, 106, thereby forming a venturi-type arrangement. Alternatively, cooling air passageway 102 can continuously widen as it extends axially from one end 104,106 to the other end 104, 106. In either configuration, motor shroud 22 is operable to separate displaced air flowing past motor 22 into cooling air which flows through cooling air passageway 102 and general air which flows outside of outer shroud surface 84.

Referring to FIGS. 1, 3, and 5, outer shroud surface 84 preferably includes a plurality of dimples 108 circumscribing outer shroud surface 84 and axially spaced from proximal and distal shroud ends 88, 90. Preferably, dimples 108 are located at an apex of outer shroud surface 84. Dimples 108 are operable to reduce drag by creating a thin turbulent air layer to aid the general air in changing directions as it flows over the apex of outer shroud surface 84. Dimples 108 can be circular in shape (as illustrated in FIGS. 1 and 3). Alternatively, dimples 180 can be elliptical, oval, or teardrop shaped.

Figure 6:
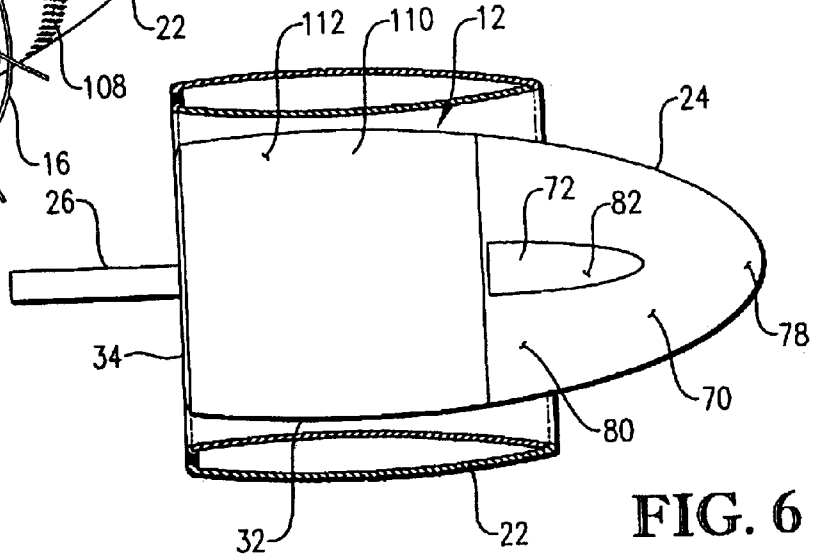
FIG. 6 is a partial sectional top view of an alternative fan with a motor shroud and distributor core coupled to an alternatively shaped fan motor, particularly illustrating the shape of the outer surface of the motor and distributor core.

Referring to FIG. 6, fan motor 12 is illustrated with an alternatively shaped motor housing 110. Alternative motor housing 110 presents an outer sidewall surface 112 which is generally toroidal in shape. The shape of outer sidewall surface 112 corresponds with the shape of outer core surface 70 so that the curved profile of outer sidewall surface 112 and outer core surface 70 is substantially smooth. Preferably, outer sidewall surface 112 and outer core surface 70 cooperate to form a generally truncated ellipsoidal outer surface.

The pressure housing described herein is suitable for either conventional forward-flow fans, where air is drawn over the motor by the fan blades, as well as reverse flow motors, where air is pushed by the fan blades over the fan motor. In either configuration, air turbulence and drag of the fan system is minimized, thereby enhancing the efficiency of the fan.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A propeller-type cooling fan having a motor which powers fan blades to thereby cause air to flow past the motor, said fan comprising:

a motor housing presenting an axially extending outer sidewall surface; and a motor shroud radially spaced from the outer sidewall surface and surrounding at least a portion of the outer sidewall surface, said motor shroud presenting inner and outer shroud surfaces, said inner shroud surface and said outer sidewall surface defining an axially extending motor-cooling air passageway therebetween, such that air flowing past the motor is separated into motor-cooling air flow within the motor-cooling air passageway and general air flow outside the outer shroud surface.

2. A fan according to claim 1, said outer shroud surface including a plurality of inwardly extending dimples, said inner shroud surface being substantially smooth.

3. A fan according to claim 2, said dimples circumscribing an apex of the outer shroud surface.

4. A fan according to claim 1; and a buttress guard rigidly coupled to the motor housing and the motor shroud.

5. A fan according to claim 4, said motor shroud being supported relative to the motor housing solely by the buttress guard.

6. A fan according to claim 1; and a mounting bracket rigidly coupled to the outer sidewall surface of the motor housing and extending radially therefrom.

7. A fan according to claim 6, said motor shroud defining a support opening in the outer and inner shroud surfaces, said mounting bracket extending through the support opening.

8. A propeller-type cooling fan having a motor which powers fan blades to thereby cause air to flow past the motor, said fan comprising:

a motor housing presenting an axially extending outer sidewall surface; and a motor shroud radially paced from the outer sidewall surface and surrounding at least a portion of the outer sidewall surface, said motor shroud presenting inner and outer shroud surfaces, said inner shroud surface and said outer sidewall surface defining an axially extending motor-cooling air passageway therebetween, said motor-cooling air passageway having first and second axially spaced open passageway ends, said motor-cooling air passageway being narrower between the first and second passageway ends than at either of the first or second passageway ends.

9. A fan according to claim 8, said outer sidewall surface being substantially toroidal.

10. A propeller-type cooling fan having a motor which powers fan blades to thereby cause air to flow past the motor, said fan comprising:

a motor housing presenting an axially extending outer sidewall surface; and a motor shroud radially spaced from the outer sidewall surface and surrounding at least a portion of the outer sidewall surface, said motor shroud presenting inner arid outer shroud surfaces, said inner shroud surface and said outer sidewall surface defining an axially extending motor-cooling air passageway therebetween, said motor shroud including axially spaced first and second shroud ends, said inner and outer shroud surfaces converging toward one another as the shroud surfaces extend axially toward the first shroud end.

11. A fan according to claim 10, said inner and outer shroud surfaces converging toward one another as the shroud surfaces extend axially toward the second shroud end.

12. A fan according to claim 11, said inner and outer shroud surfaces abutting one another at the first shroud end.

13. A fan according to claim 10, said second shroud end including an attachment wall extending radially between the inner and outer shroud surfaces.

14. A fan according to claim 13; and a buttress guard rigidly coupled to the attachment wall.

15. A fan according to claim 14, said motor housing including a substantially flat radially extending end wall.

16. A fan according to claim 15, said buttress guard being coupled to the end wall via a plurality of threaded guard fasteners, said buttress guard being coupled to the attachment wall via a plurality of threaded shroud fasteners.

17. A fan according to claim 10, said first shroud end being spaced further from the fan blades than the second shroud end.

18. A cooling fan comprising:

a motor having first and second axially spaced ends;

a drive shaft extending from the first end of the motor, powered by the motor, and rotatable on a motor axis;

a fan blade assembly including a hub rigidly coupled to the drive shaft;

a spinner rigidly coupled to the drive shaft and at least partly covering the hub, said spinner presenting a substantially smooth outer spinner surface having a rounded spinner end portion; and a distributor core positioned proximate the second end of the motor, said distributor core presenting a substantially smooth outer core surface having a rounded core end portion, said motor including a housing having first and second axially spaced end walls and a side wall extending between the end walls, said drive shaft extending through the first end wall, said distributor core being coupled to the second end wall, said outer core surface including a base core portion which is substantially flush with an outer sidewall surface of the sidewall, said distributor core including a plurality of recessed screw sockets receiving a plurality of threaded core fasteners for attaching the distributor core to the second end wall, said distributor core including a plurality of fairings for covering the recessed screw sockets, said fairings presenting a portion of the outer core surface.

19. A fan according to claim 18; and a motor shroud radially spaced from and surrounding at least a portion of the motor.

20. A fan according to claim 19, said outer sidewall surface cooperating with an inner shroud surface of the motor shroud to define an axially extending cooling air passageway between the motor shroud and the motor, said cooling air passageway having first and second axially spaced open passageway ends.

21. A cooling fan comprising:

a motor having first and second axially spaced ends;

a drive shaft extending from the first end of the motor, powered by the motor, and rotatable on a motor axis a fan blade assembly including a hub rigidly coupled to the drive shaft;

a spinner rigidly coupled to the drive shaft and at least partly covering the hub said spinner presenting a substantially smooth outer spinner surface having a rounded spinner end portion;

a distributor core positioned proximate the second end of the motor, said distributor core presenting a substantially smooth outer core surface having a rounded core end portion; and a motor shroud radially spaced from and surrounding at least a portion of the motor, said motor including a housing having an axially extending sidewall, said sidewall presenting an outer sidewall surface which cooperates with an inner shroud surface of the motor shroud to define an axially extending motor-cooling air passageway between the motor shroud and the motor, said motor-cooling air passageway having first and second axially spaced open passageway ends, said motor-cooling air passageway being narrower between the first and second passageway ends than at either of the first or second passageway ends.

22. A fan according to claim 21, said motor housing having first and second axially spaced end walls and said sidewall extending between the end walls, said drive shaft extending through the first end wall, said distributor core being coupled to the second end wall.

23. A fan according to claim 22, said outer core surface including a base core portion which is substantially flush with the outer sidewall surface of the sidewall.

24. A fan according to claim 22, said outer spinner surface including a spinner based portion which is substantially flush with the outer sidewall surface of the sidewall.

25. A fan according to claim 22; and a backplate rigidly coupled to the drive shaft and the spinner, said backplate being axially positioned between the first end wall and the hub.

26. A fan according to claim 21, said inner shroud surface being substantially smooth.

27. A fan according to claim 26, said outer sidewall surface being substantially cylindrical.

28. A fan according to claim 19, said motor shroud presenting a substantially smooth outer shroud surface.

29. A fan according to claim 28, said outer shroud surface including a plurality of inwardly extending dimples.

30. A method of circulating air with a cooling fan, said method comprising the steps of:

(a) rotating a fan blade assembly to thereby force air to flow past a motor which provides power for rotating the fan blade assembly; and (b) separating the air flowing past the motor into a motor-cooling air flow and a general air flow, said motor-cooling air flow flowing between an outer sidewall surface of the motor and an inner shroud surface of a motor shroud surrounding the motor, said general air flow flowing outside an outer shroud surface of the motor shroud.

31. A method according to claim 30; and (c) passing at least a portion of the air flowing past the motor over a rounded tip of a spinner positioned proximate a first end of the motor, said spinner rotating with the fan blade assembly.

32. A method according to claim 31; and (d) passing at least a portion of the air flowing past the motor over a rounded tip of a distributor core positioned proximate a second end of the motor.

33. A method according to claim 32, said spinner and said distributor core having substantially smooth outer surfaces.

34. A method according to claim 33, said inner and outer shroud surfaces being substantially smooth.

35. A propeller-type cooling fan having a motor, said fan comprising:

at least one fan blade powered by the motor to thereby cause air to flow past the motor;

a motor housing presenting an axially extending outer sidewall surface; and a motor shroud radially spaced from the outer sidewall surface and surrounding at least a portion of the outer sidewall surface, said motor shroud presenting inner and outer shroud surfaces, with the at least one fan blade projecting radially outward beyond the outer shroud surface, said inner shroud surface and said outer sidewall surface defining an axially extending motor-cooling air passageway therebetween.

36. A fan according to claim 35, said outer shroud surface including a plurality of inwardly extending dimples, said inner shroud surface being substantially smooth.

37. A fan according to claim 36, said dimples circumscribing an apex of the outer shroud surface.

38. A fan according to claim 35; and a buttress guard rigidly coupled to the motor housing and the motor shroud.

39. A fan according to claim 38, said motor shroud being supported relative to the motor housing solely by the buttress guard.

40. A fan according to claim 35, said motor-cooling air passageway having first and second axially spaced open passageway ends, said motor-cooling air passageway being narrower between the first and second passageway ends than at either of the first or second passageway ends.

41. A fan according to claim 40, said outer sidewall surface being substantially toroidal.

42. A fan according to claim 35, said motor shroud including axially spaced first and second shroud ends, said inner and outer shroud surfaces converging toward one another as the shroud surfaces extend axially toward the first shroud end.

43. A fan according to claim 42, said inner and outer shroud surfaces converging toward one another as the shroud surfaces extend axially toward the second shroud end.

44. A fan according to claim 43, said inner and outer shroud surfaces abutting one another at the first shroud end.

45. A fan according to claim 42, said second shroud end including an attachment wall extending radially between the inner and outer shroud surfaces.

46. A fan according to claim 45; and a buttress guard rigidly coupled to the attachment wall.

47. A fan according to claim 46, said motor housing including a substantially flat radially extending end wall.

48. A fan according to claim 47, said buttress guard being coupled to the end wall via a plurality of threaded guard fasteners, said buttress guard being coupled to the attachment wall via a plurality of threaded shroud fasteners.

49. A fan according to claim 42, said first shroud end being spaced further from the at least one fan blade than the second shroud end.

50. A fan according to claim 35; and a mounting bracket rigidly coupled to the outer sidewall surface of the motor housing and extending radially therefrom.

51. A fan according to claim 50, said motor shroud defining a support opening in the outer and inner shroud surfaces, said mounting bracket extending through the support opening.

* * * * *